US009174112B1

(12) United States Patent
Park

(10) Patent No.: US 9,174,112 B1
(45) Date of Patent: Nov. 3, 2015

(54) SYNTHETIC LOW-MAINTENANCE BOCCE COURT

(71) Applicant: Philip Park, Walnut Creek, CA (US)

(72) Inventor: Philip Park, Walnut Creek, CA (US)

( * ) Notice: Subject to any disclaimer, the term of this patent is extended or adjusted under 35 U.S.C. 154(b) by 0 days.

(21) Appl. No.: 14/320,360

(22) Filed: Jun. 30, 2014

(51) Int. Cl.

| | |
|---|---|
| ***A63C 19/00*** | (2006.01) |
| ***A63B 67/06*** | (2006.01) |
| ***A63C 19/02*** | (2006.01) |
| *E01C 13/00* | (2006.01) |

(52) U.S. Cl.
CPC ..... *A63C 19/00* (2013.01); *A63B 67/066* (2013.01); *A63C 19/02* (2013.01)

(58) Field of Classification Search
CPC ..... E01C 13/00; E01C 13/02; E01C 13/06; E01C 13/08; E01C 13/045; B32B 33/00; B32B 5/12; B32B 3/02
USPC ..... 472/88, 92, 94, 90; 428/86, 87, 95, 96
See application file for complete search history.

(56) References Cited

U.S. PATENT DOCUMENTS

| | | | | |
|---|---|---|---|---|
| 4,112,176 | A * | 9/1978 | Bailey | 428/95 |
| 4,606,963 | A * | 8/1986 | Farrell | 428/150 |
| 4,897,302 | A * | 1/1990 | Bull | 442/395 |
| 5,352,158 | A * | 10/1994 | Brodeur, Jr. | 472/92 |
| 5,411,352 | A * | 5/1995 | Eren | 404/31 |
| 7,186,450 | B2 * | 3/2007 | Foxon | 428/86 |
| 7,713,133 | B2 * | 5/2010 | Wolf | 472/91 |
| 2010/0093452 | A1 * | 4/2010 | Kim | 464/111 |

* cited by examiner

*Primary Examiner* — Kien Nguyen
(74) *Attorney, Agent, or Firm* — Leydig, Voit & Mayer, Ltd.

(57) ABSTRACT

A synthetic, low maintenance bocce court with a surface comprising (a) a force-reduction layer comprising a open or closed cell foam material having a density with Shore A Durometer hardness of about 25 or more; (b) an embedding resin; (c) a bonding layer between the force reduction layer and the embedding resin, wherein the bonding layer comprises a non-woven mesh embedded in a polymer resin and, optionally, fused to a polymer wear layer; (d) elastomeric particles embedded in the embedding resin; and (e) a finish layer over the elastomeric particles and embedding resin; as well as a method of manufacturing same.

22 Claims, 1 Drawing Sheet

1. UNDER SLAB 15 MIL VAPOR BARRIER
2. CONCRETE SUBFLOOR
3 MOISTURE CONTROL SYSTEM
4. LEVELING COMPOUND
5. TWO-PART POLYURETHANE ADHESIVE
6. HIGH DENSITY CLOSED CELL PVC FOAM
7. PVC/FIBERGLASS LAYER
8. CLEAR PVC
9. EMBEDDING RESIN
10. EPDM
11. 5MM WELD ROD
12. EMBEDDING RESIN OVER WELD JOINT
13. CLEAR FINISH LAYER

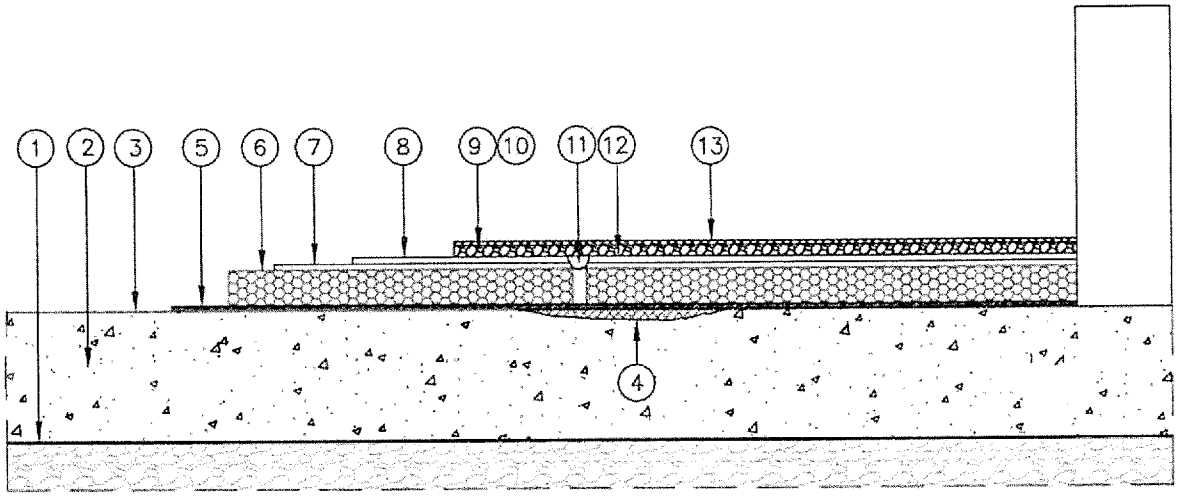
1. UNDER SLAB 15 MIL VAPOR BARRIER
2. CONCRETE SUBFLOOR
3 MOISTURE CONTROL SYSTEM
4. LEVELING COMPOUND
5. TWO-PART POLYURETHANE ADHESIVE
6. HIGH DENSITY CLOSED CELL PVC FOAM
7. PVC/FIBERGLASS LAYER
8. CLEAR PVC
9. EMBEDDING RESIN
10. EPDM
11. 5MM WELD ROD
12. EMBEDDING RESIN OVER WELD JOINT
13. CLEAR FINISH LAYER

SYNTHETIC LOW-MAINTENANCE BOCCE COURT

BACKGROUND OF THE INVENTION

Bocce is traditionally played on courts of clay, sometimes with sand or crushed oyster shells as a surface layer. These traditional bocce courts require constant maintenance and proper hydration to remain playable. Frequent raking, rolling and hydrating is needed to keep the playing surface level and smooth, and to remove grooves and indentations left from previous rounds of play. The rigorous maintenance requirements of traditional bocce courts have led others to employ synthetic materials, particularly artificial grass, as a surface for bocce courts. Conventional synthetic surfaces, however, do not provide the proper ball bounce, rolling speed and resistance, or other characteristics of traditional bocce courts. Thus, there remains a need for improved low-maintenance bocce courts.

BRIEF SUMMARY OF THE INVENTION

The invention provides a synthetic, low maintenance bocce court with a surface comprising (a) a force-reduction layer comprising a open or closed cell foam material having a density with Shore A Durometer hardness of about 25 or more; (b) an embedding resin; (c) a bonding layer between the force reduction layer and the embedding resin, wherein the bonding layer comprises a non-woven mesh embedded in a polymer resin and fused to a polymer wear layer; (d) elastomeric particles embedded in the embedding resin; and (e) a finish layer over the elastomeric particles and embedding resin.

The invention also provides a method of manufacturing a bocce court, the method comprising (a) applying an embedding resin over a force reduction layer comprising an open or closed cell foam having Shore A Durometer hardness of about 25 or more; (b) embedding elastomeric particles in the embedding resin; and (c) applying a clear finish layer over the elastomeric particles.

BRIEF DESCRIPTION OF THE SEVERAL VIEWS OF THE DRAWING(S)

FIG. 1 is a diagram of a synthetic bocce court in accordance with the invention.

DETAILED DESCRIPTION OF THE INVENTION

The invention provides a synthetic, low maintenance bocce court that provides a ball bounce and rolling resistance similar to a traditional bocce ball court. The bocce ball court comprises a surface comprising (a) a force-reduction layer comprising an open or closed cell foam material having a density with Shore A Durometer hardness of about 25 or more; (b) an embedding resin; (c) a bonding layer between the force reduction layer and the embedding resin, wherein the bonding layer comprises a non-woven mesh embedded in a polymer resin and fused to a polymer wear layer; (d) elastomeric particles embedded in the embedding resin; and (e) a finish layer over the elastomeric particles and embedding resin.

The bocce ball court provides a low bounce surface needed for the sport of bocce ball. The force-reduction layer and bonding layer laid over a concrete slab provides a ball rebound of about 40% or less (e.g., about 35% or less, about 30% or less, about 25% or less, or even about 20% or less or about 15% or less) than the ball rebound of a concrete surface.

Ball rebound, for the purposes discussed herein is determined by dividing the height of the rebound of a plastic resin bocce ball with a diameter of 107 mm and weight of 920 g dropped on the bonding layer and force reduction layer laid over a concrete slab by the height of the rebound of the same bocce ball dropped from the same height directly on a concrete slab.

The elastomeric particles and finish layer, combined with appropriate force reduction and other layers, provides a rolling resistance appropriate for traditional bocce play. Rolling resistance can be measured using a stimpmeter, which is a ramp with a 145° V-shaped groove extending along its length and set to the ground at a given angle. A ball released from a given height on the ramp is allowed to roll onto the bocce court surface and the distance that the ball rolls away from the ramp reflects the rolling resistance of the surface. The measurement is repeated until three measurements within 8" of each other are obtained, and an average of the three measurements is used. According to one embodiment, the court surface has a stimpmeter rolling distance of about 15-25 feet, such as about 18-23 feet, when measured using a plastic resin bocce ball with a diameter of 107 mm and weight of 920 g and a stimpmeter with an incline of 35° from a level surface and a release height of 9 inches.

The force reduction layer can comprise any open or closed cell foam material. The foam material helps absorb impact of the bocce ball dropped on the surface and reduces rebound, but should be firm enough to reduce or eliminate excessive indentations in the surface. Thus, the foam material generally has a Shore A Durometer hardness of about 25 or more (e.g., about 30 or more, about 40 or more, or about 50 or more). In some embodiments, the foam material will have a hardness less than about 25 when thinner or less open or closed cell foam is used to reduce cost. Typically, the open or closed cell foam will have a Shore A hardness of less than about 90 (e.g., less than about 80, less than about 70, or less than about 60). Any suitable foam material can be used. Suitable materials include, for example, polyvinylchloride (PVC), polystyrene, polyethylene, or polyproplylene.

A bonding layer is positioned over and optionally bound to the force reduction layer. The bonding layer comprises a non-woven mesh embedded in a polymer resin, such as PVC resin. The non-woven mesh can be any suitable material, such as fiberglass or a polymer mesh (e.g., polyamide, polyester, polyethylene terephthalate, etc.). The bonding layer is, optionally, laminated or fused to a wear layer, or instance, an additional layer of polymer (e.g., PVC) resin or film. In one embodiment, the wear layer is a clear PVC layer.

The embedding resin is a layer of resin cast on the bonding layer (e.g., on the wear layer of the bonding layer) in which the elastomeric particles are embedded. The embedding resin can be any type of polymer that can be cast in place, and which can bind the selected type of elastomeric particles used in the court surface. Suitable resins include, for example, polyurethane elastomeric resins or epoxy resins. The embedding resin should have strength, flexibility, and hardness characteristics that will enable the resin to withstand bocce play (ball impact, footsteps of players, weather and sunlight exposure) without degrading or releasing the embedded elastomeric particles. In some embodiments, the embedding resin has a tensile strength of about 680 psi to 730 psi, a Shore A hardness of about 45-55, an elongation at break of about 350-430, and/or tear strength of about 90 to 120 pli.

The elastomeric particles embedded in the embedding resin can have any suitable size, shape, and material that provide the desired court surface characteristics (e.g., ball bounce and rolling resistance). Typically, the elastomeric particles will have an average particle size (diameter) of about 0.5 to 1 mm. The elastomeric particles should have characteristics that will enable the resin to withstand bocce play (ball impact, footsteps of players, weather and sunlight exposure) without degrading or prematurely wearing. The elastomeric particles can be made of a natural or synthetic elastomeric material, such as natural or synthetic rubber (e.g., ethylene propylene diene monomer (EPDM)), styrene ethylene butylene styrene (SEBS), styrene butadiene styrene (SBS) or ethylene propylene copolymers (EPM).

The elastomeric particles embedded in the embedding resin provide a texture layer having a thickness suitable to provide the desired play characteristics. In some embodiments, the texture layer is about 1-5 mm thick, such as about 2-3.5 mm thick or 2.5-3 mm thick.

The finish layer that is applied over the elastomeric particles and embedding resin is a thin composition that coats the particles and spaces between the particles, without completely filling the gaps between the particles. The finish layer should protect the court surface (the elastomeric particles and embedding resin) from exposure to the weather and sunlight. In one embodiment, the finish layer comprises an aliphatic isocyanate (aliphatic polyisocyanate). The finish layer can be pigment or clear.

The bocce court should have a suitable base material that resists settling and supports the other layers of the court described herein. The base material can be provided by pouring a concrete slab base. The force reduction layer can be coupled to the concrete slab, optionally with an intervening adhesive layer. A moisture vapor reduction system can be placed between the base material and the force reduction layer to inhibit moisture penetration from the concrete into the surface layers of the bocce court. Any suitable moisture barrier can be used. In a preferred embodiment, the surface of the concrete on which the force reduction layer is placed is coated with moisture resistant coating, such as a 2 part epoxy resin. This resin should have a very low permeance (ASTM E96 wet: 0.04-0.09) and excellent bonding characteristics, and be resistant to sustained high alkalinity (ph of 14). A vapor barrier also can be provided underneath the base material to reduce moisture penetration from the ground into the base material. Suitable vapor barriers include any of various moisture barrier sheets or films commercially available. In one embodiment, the vapor barrier is a sheet or film with a thickness of at least 15 mils.

The bocce court typically has a substantially rectangular shape with a width and length suitable for bocce play. Generally, the bocce court will have a width of about 8 feet to about 13 feet and a length of about 60 feet to about 90 feet.

The bocce court can comprise a curb around the perimeter of the rectangular shaped court with a height above the court surface sufficient to retain bocce balls inside the court perimeter. Typically, the curb extends above the surface of the court by about 4 inches to about 12 inches.

The bocce court desirably has a drainage system for removing water from the surface of the court and/or the ground beneath the court. The drainage system can comprise weep holes or other portals in the curb surrounding the court through which water can escape, as well as drainage tiles surrounding or beneath the base material.

Other materials and components typically used in the installation of a bocce court can also be used in accordance with the invention. For instance, a leveling compound may be used over the concrete slab to achieve a level surface as needed. Also, adhesives may be used to adhere any of the various layers to an adjacent layer.

The bocce court can be manufactured by any suitable method. In a preferred aspect of the invention, the bocce court is made by (a) providing a bonding layer over a force reduction layer, wherein the bonding layer comprises a non-woven mesh embedded in a polymer resin and fused to a polymer wear layer, and the force reduction layer comprises a open or closed cell foam having Shore A Durometer hardness of about 25 or more; (b) applying an embedding resin over the bonding layer; (c) embedding elastomeric particles in the embedding resin; and (d) applying a clear finish layer over the elastomeric particles.

The force reduction layer is provided over a suitable base material, as previously described. The base material and the ground beneath the base material, as well as any subterranean drainage system are prepared by conventional techniques. The force reduction layer can be bonded to the base material or an intervening layer (e.g., leveling compound or moisture barrier), or the force reduction layer can "float" over the base material, held in place by the weight of the other layers. Preferably, the force reduction layer is adhered to the base material.

The bonding layer over the force reduction layer can be provided by applying a fused sheet material comprising the non-woven mesh embedded in a polymer resin and fused to a polymer wear layer to the force reduction layer. The wear layer should be positioned upwards, away from the force reduction material. The bonding layer should be adhered to the force reduction layer.

The force reduction layer and/or bonding layer may be provided in multiple sheets to fill the court area, with the edges of the sheets abutting at seams. It is preferred the seams of the force reduction layer and/or bonding layer are affixed, most preferably by polymeric welding of the seams.

The embedding resin can be applied to the bonding layer (e.g., the wear layer of the bonding layer) as a liquid. Before the embedding resin is completely hardened, the elastomeric particles are evenly distributed across the surface of the court at a substantially uniform density. The particles should be distributed to a rate of refusal, whereby no embedding resin can be seen. Casting is done so as to not displace any of the embedding resin during distribution of the particles. The particles embed into the embedding resin, and the resin is allowed to harden.

The following example further illustrates the invention but, of course, should not be construed as in any way limiting its scope.

Example

FIG. 1 provides an example of a bocce court in accordance with the invention viewed from a cross-section. A concrete slab 2 is provided with high spots ground level and low spots filed with leveling compound 4. No concrete curing, hardening, or sealing agents are used. A 15 mil vapor barrier 1 (ASTM E 1745 (7) permeance of less than about 0.01) is provided directly under the concrete slab 2. The exposed surface of the concrete slab 2 is shot blasted or otherwise mechanically prepared (e.g., to an ICRI Concrete Surface Profile of 3), and an epoxy-based or other suitable moisture control system 3 is applied to the top surface of the concrete slab and allowed to harden/cure. Two-component polyurethane adhesive 5 formulated for outdoor use is applied to the moisture barrier 3 treated surface of the concrete slab 2. A force reduction layer 6 of 5 mm high density closed-cell PVC previously cut to fit is applied to the adhesive 5. A two-part bonding layer having a first layer 7 of about 2 mm PVC/fiberglass (non-woven fiberglass mesh embedded in PVC resin) and a wear layer 8 of clear PVC bonded together is positioned over the force reduction layer 6. A 100 lb segmented roller is used to remove entrapped air, and weights positioned to hold all cross seams. Side and end seams of the force reduction/bonding layers 6, 7, 8 are joined using hot welding and 5 mm vinyl welding thread 11. The surface of the wear layer 8 is sanded to improve bonding texture, and any dust removed. A two-part polyurethane elastomer embedding resin is prepared having a tensile strength (ASTM D 412) of 707 psi, Shore A 50 Durometer hardness (ASTM D 2240), 400% elongation (ASTM D 412), and 103 pli tear strength (ASTM D 624). A skim coat 12 of the embedding resin is applied to level the seams of the bonding layer. A texture layer is prepared by applying the embedding resin 9 to a uniform thickness of 1.5 to 2 mm using a notched squeegee. The embedding resin is applied wet-to-wet to create a seamless surface. Before substantial curing of the embedding resin 9, EPDM granules 10 (e.g., peroxide cured EPDM with about ½ mm to about 1 mm particle size) are broadcast applied to the wet embedding resin 9 to a point of excess. The surface is allowed to cure for 12 hours, and excess EPDM granules are removed, leaving a cured texture approximately 2.5-3 mm thick. A finish layer 13 of a clear, non-yellowing, 100% solids formulation of aliphatic isocyanate-based moisture curing coating (without methyl diphenyl diisocyanate (MDI) or toluene diisocyanturate (TDI) components) is applied over the EPDM granules 10 and any exposed embedding resin 9.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A synthetic, low-maintenance bocce court with a surface comprising:

(a) a force-reduction layer comprising a closed cell foam material having a density with Shore A Durometer hardness of about 25 or more;

(b) an embedding resin;

(c) a bonding layer between the force reduction layer and the embedding resin, wherein the bonding layer comprises a non-woven mesh embedded in a polymer resin and, optionally, fused to a polymer wear layer;

(d) elastomeric particles embedded in the embedding resin; and (e) a finish layer over the elastomeric particles and embedding resin.

2. The bocce court of claim 1, wherein the force-reduction layer and bonding layer laid over a concrete slab provides a ball rebound of about 40% or less than the ball rebound of a concrete surface, and wherein the ball rebound is determined by dividing the height of the rebound of a plastic resin bocce ball with a diameter of 107 mm and weight of 920 g dropped on the bonding layer and force reduction layer laid over a concrete slab by the height of the rebound of the same bocce ball dropped from the same height directly on a concrete slab.

3. The bocce court of claim 1, wherein the court surface has a stimpmeter rolling distance of about 15-25 feet as measured using a plastic resin bocce ball with a diameter of 107 mm and weight of 920 g and a stimpmeter with an incline of 35° from a level surface and a release height of 9 inches.

4. The bocce court of claim 1, wherein the closed cell foam layer is PVC.

5. The bocce court of claim 1, wherein the embedding resin is a cast polyurethane elastomeric resin.

6. The bocce court of claim 1, wherein the embedding resin has a tensile strength of about 680 psi to 730 psi, a Shore A hardness of about 45-55, an elongation at break of about 350-430, and a tear strength of about 90 to 120 pli.

7. The bocce court of claim 1, wherein the elastomeric particles are ethylene propylene diene monomer (EPDM) rubber particles.

8. The bocce court of claim 1, wherein the elastomeric particles have a particle size of 0.5 mm to 1 mm.

9. The bocce court of claim 1, wherein the finish layer comprises an aliphatic isocyanate and is, optionally, clear.

10. The bocce court of claim 1, wherein bonding layer is bonded to the force-reduction layer and the embedding resin is bonded to the bonding layer.

11. The bocce court of claim 1, further comprising a concrete slab base, wherein the force reduction layer is coupled to the concrete slab, optionally with an intervening adhesive layer, moisture barrier, or both.

12. The bocce court of claim 1 having a substantially rectangular shape with a width of about 8 feet to about 13 feet and a length of about 60 feet to about 90 feet.

13. The bocce court of claim 10, further comprising a curb around the perimeter of the rectangular shaped court, wherein the curb extends above the surface of the court by about 4 inches to about 12 inches.

14. A method of manufacturing a bocce court, the method comprising:

(a) providing a bonding layer over a force reduction layer, wherein the bonding layer comprises a non-woven mesh embedded in a polymer resin and fused to a polymer wear layer, and the force reduction layer comprises a open or closed cell foam having Shore A Durometer hardness of about 25 or more;

(b) applying an embedding resin over the bonding layer;

(c) embedding elastomeric particles in the embedding resin; and (d) applying a clear finish layer over the elastomeric particles.

15. The method of claim 12 further comprising adhering a bonding layer to the force reduction layer, wherein the bonding layer is a non-woven mesh embedded in a polymer resin and fused to a polymer wear layer, and wherein the embedding resin is applied to the bonding layer.

16. The method of claim 13 further comprising adhering the force reduction layer and bonding layer to a concrete slab base and, optionally, an intervening moisture barrier, before applying the embedding resin to the bonding layer.

17. The method of claim 12, wherein the force-reduction layer and bonding layer laid over a concrete slab provides a ball rebound of about 40% or less than the ball rebound of a concrete surface, and wherein the ball rebound is determined by dividing the height of the rebound of a plastic resin bocce ball with a diameter of 107 mm and weight of 920 g dropped on the bonding layer and force reduction layer laid over a concrete slab by the height of the rebound of the same bocce ball dropped from the same height directly on a concrete slab.

18. The method of claim 12, wherein the closed cell foam layer is PVC.

19. The method of claim 12, wherein the embedding resin is a polyurethane elastomeric resin.

20. The method of claim 12, wherein the embedding resin has a tensile strength of about 680 psi to 730 psi, a Shore A hardness of about 45-55, an elongation at break of about 350-430%, and a tear strength of about 90 to 120 pli.

21. The method of claim 12, wherein the elastomeric particles are ethylene propylene diene monomer (EPDM) rubber particles, optionally having a particle size of about 0.05 to about 1 mm.

22. The method of claim 12, wherein bocce court has a substantially rectangular shape with width of about 8 feet to about 13 feet, and a length of about 60 feet to about 90 feet.

* * * * *